United States Patent [19]

Boeniger et al.

[11] Patent Number: 4,773,174

[45] Date of Patent: Sep. 27, 1988

[54] CLAMPING APPARATUS FOR FLAT REPRODUCTIONS

[75] Inventors: Hanspeter Boeniger, Widen; Peter Küng, Bremgarten; Otto Dürst, Berikon, all of Switzerland

[73] Assignee: Stutz Foto-Color-Technik AG, Bremgarten, Switzerland

[21] Appl. No.: 16,911

[22] Filed: Feb. 20, 1987

[30] Foreign Application Priority Data

Feb. 20, 1986 [CH] Switzerland ..... 700/86

[51] Int. Cl.[4] ..... G09F 1/12

[52] U.S. Cl. ..... 40/156; 40/603; 40/647

[58] Field of Search ..... 40/156, 152, 152.1, 40/603

[56] References Cited

U.S. PATENT DOCUMENTS

| | | | |
|---|---|---|---|
| 1,408,079 | 2/1922 | Davis | 40/603 X |
| 1,484,231 | 2/1924 | Pistocco | 40/617 |
| 2,484,394 | 10/1949 | Kelly | 40/617 |
| 4,547,987 | 10/1985 | Stilling | 40/603 |

FOREIGN PATENT DOCUMENTS

| | | | |
|---|---|---|---|
| 0132953 | 7/1985 | European Pat. Off. . | |
| 26952 | of 1907 | United Kingdom | 40/603 |
| 2142459 | 1/1985 | United Kingdom . | |

*Primary Examiner*—Gene Mancene
*Assistant Examiner*—Wenceslao J. Contreras
*Attorney, Agent, or Firm*—Browdy and Neimark

[57] ABSTRACT

The supporting and suspending frame, detachably assembled from a plurality of supporting frame elements, serves to suspend flat reproductions, in particular photographic reproductions, of paper, film or fabric smoothly in the frame by means of tensioning springs. Every supporting frame element has an at least partly circularly curved narrow side and a contiguous flat wide side at right angles thereto. The inside face of the wide side is provided with a supporting member that extends in the longitudinal direction of the wide side and is open in the transverse direction of the wide side. The tensioning springs, which are fastened to the edges of the reproduction by means of eyes, can be suspended directly in and displaced along the supporting member. As a result, it is possible to wrap the reproduction over the wide side and the narrow side toward the back side of the supporting frame element and there fasten it smoothly by means of the suspended tensioning springs, so that the reproduction is clamped or displayed in a "borderless" manner.

8 Claims, 2 Drawing Sheets

CLAMPING APPARATUS FOR FLAT REPRODUCTIONS

BACKGROUND OF THE INVENTION

The present invention relates to a supporting and suspending apparatus for flat reproductions, in particular photographic reproductions.

For a long time it has been known to display flat photographic images on paper or film in an outer rectangular frame by means of tensioning springs, which are secured at one end along the edge of the image and on the other along the associated frame element. From European Patent Application No. 84 304 393.6 (Publication No. 0 132 953), a display apparatus of this kind has also become known, in which a plurality of profiled frame elements, joined detachably together by clamping fasteners to make a frame, have internal rails in which slides are disposed, and in which the tensioning springs that are fastened to the reproduction can be suspended. The disadvantages of this known display apparatus are that it is relatively complicated to produce, that care must always be taken to insert enough slides when the frame is assembled, and above all that it is impossible to attain a clamping or supporting and suspending apparatus that visually appears to be frameless, that is, one in which the reproduction extends on all sides as far as the outermost edges and is nowhere covered by a visible part of the frame.

SUMMARY OF THE INVENTION

It is the object of the present invention to devise a supporting and suspending apparatus of the generic type defined above but which needs merely simple support frame elements having means for the direct yet displaceable suspension of tensioning springs, and which makes it possible to clamp reproductions without their being covered by visible parts of the frame.

According to the invention, the supporting and suspending apparatus has the characteristics recited in the novel portion of claim 1. Exemplary embodiments of the invention will be explained in further detail below, referring to the drawings.

DESCRIPTION OF THE PREFERRED EMBODIMENTS

Figure 1:
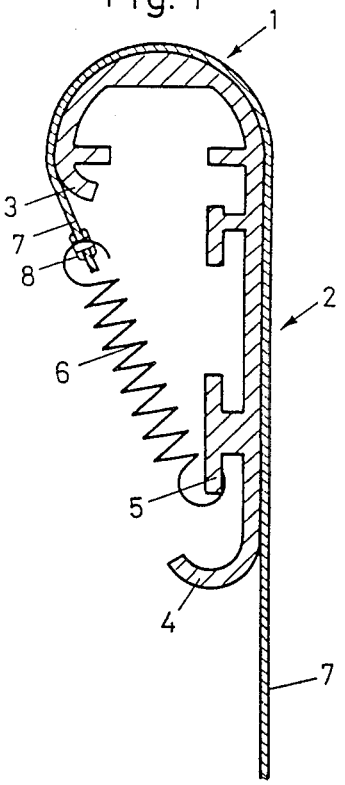
FIG. 1 is a cross section through a supporting frame element according to the drawing, with a reproduction clamped in a "borderless" manner.

FIG. 1 is a cross section of an example of a supporting frame element according to the invention. In general, the supporting frame element has one narrow side 1 and one wide side 2. The narrow side 1 is substantially semicircularly curved, with a short, inwardly curved end portion 3. The wide side 2 is flat and has a lower end portion 4 which is likewise circularly curved, but with a shorter radius than that of the semicircularly curved narrow side 1. In the interior of the supporting frame element, various protruding profiled parts or support members are provided, which serve different purposes. One such support member that should be mentioned first is a rail-like protrusion 5 located in an end portion of the wide side 2 remote from the narrow side 1; this protrusion is open toward the circularly curved end portion 4 and extends over the entire length of the supporting frame element. As shown, the rail-like protrusion 5 is used for suspending a plurality of tensioning springs 6 (only one of which is visible in FIG. 1), which with their opposite ends are suspended in eyes 8 disposed along the associated edge of the flat reproduction 7. The reproduction 7 is, as the drawing shows, guided around the semicircularly curved narrow side 1 via the contiguous wide side 2 and then extends as far as an opposed supporting frame element of the display frame, where it is guided in the same manner over its wide side and narrow side toward the inside of the supporting frame element, where it is suspended by means of tensioning springs on the supporting frame element. The same applies for the two other sides of the reproduction and of the display frame.

It is apparent that with this supporting and suspending apparatus no portions of the edges of the reproduction are covered by any parts of the frame whatever, and that smooth tensioning of the reproduction is attainable in a simple manner by displacing the tensioning springs 6 to hook one end into the rail-like protrusions 5. This "borderless" embodiment also enables a practically seamless end-to-end disposition of a plurality of identical supporting and suspending apparatuses, to make a large image having a very large area.

Figure 2:
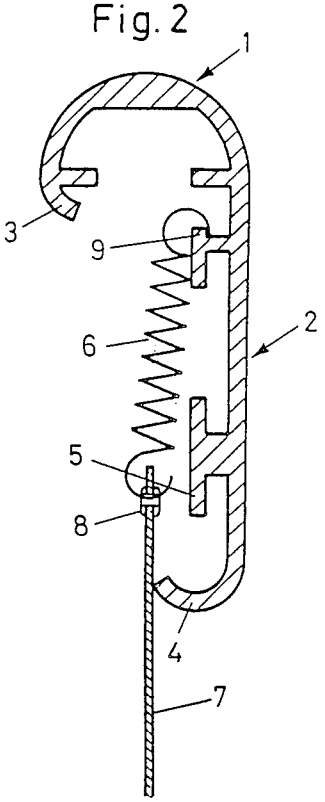
FIG. 2 is a cross section through the supporting frame element of FIG. 1, having a reproduction clamped in position such that it is covered at the edge by the frame.

FIG. 2 is a cross section of the same kind of profiled frame element in which a further protruding profiled part or supporting member is used. This is a rail-like protrusion 9 provided on the inside of the wide side near the narrow side 1; it is open toward the narrow side and extends over the entire length of the supporting frame element. As shown, the rail-like protrusion 9 serves to suspend a plurality of tensioning springs 6 (only one of which is shown in FIG. 2), which with their opposite ends are again suspended in eyes 8 disposed along the associated edge of the first reproduction 7. This kind of suspension is attainable using the same supporting frame elements as for the case of FIG. 1. Although the edge portions of the reproduction 7 are covered by the wide side 2 and the narrow side 1, the curved shapes of the narrow side 1 and the end portion 2 of the wide side 2 lend the visible frame a much more attractive, lighter appearance.

Figure 3:
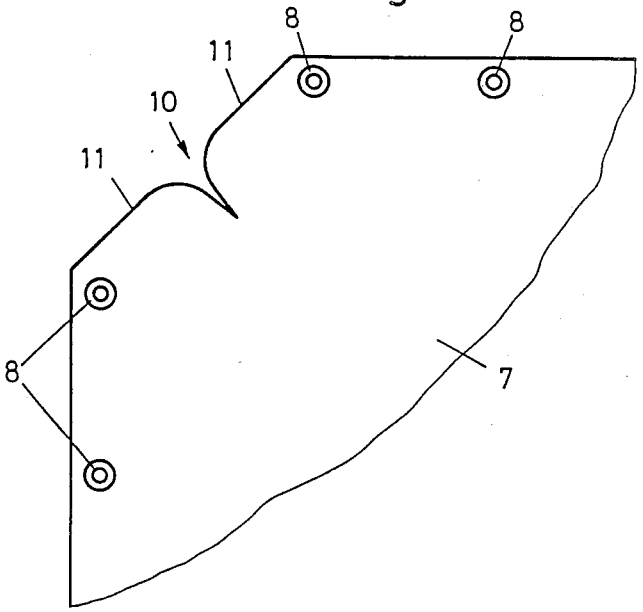
FIG. 3 is a blank for a corner area of the reproduction, for fastening in a frame having supporting frame elements as in FIG. 1.

A complete display frame is assembled from a plurality of supporting frame elements shown in FIGS. 1 and 2, and seamless corner joints are attained with suitable miter cuts. If the reproduction of FIG. 1 is being clamped, or in other words drawn over the wide sides 2 and the curved narrow sides 1, then naturally it will be necessary to cut down the corner of the reproduction 7, to prevent annoying overlap. In FIG. 3, a suitable corner cut 10 for a reproduction 7 provided with the eyes 8 on the edge is shown. With this kind of cut, the edges 11 of the cut 10 abut one another directly, that is, without overlap and without forming seams.

Figure 4:
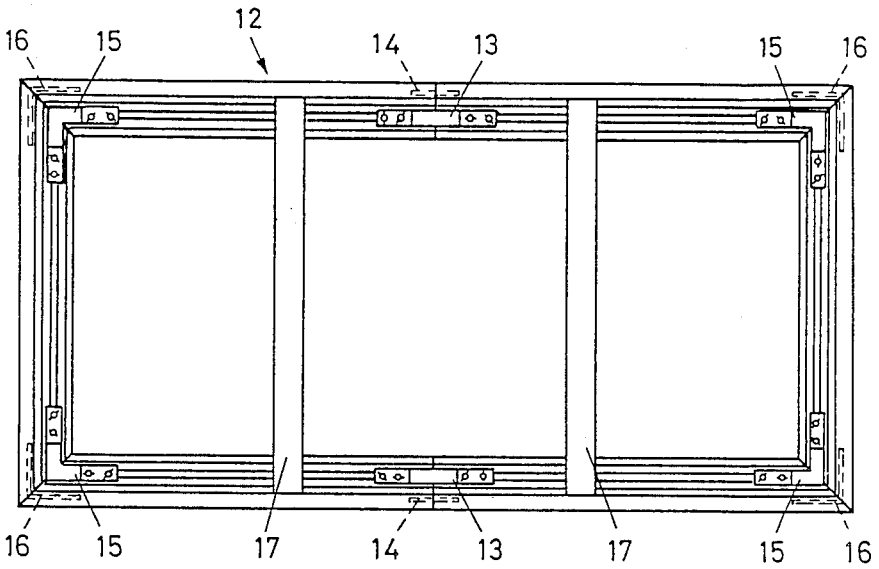
FIG. 4 is a view of the back of a frame assembled from a plurality of supporting frame elements according to FIG. 1 by means of a plurality of clamping fasteners.

In the aforementioned assembling of a plurality of supporting frame elements shown in FIGS. 1 and 2, clamping fasteners known per se are advantageously used. In FIG. 4, the back view of a complete display frame 12 is shown, with clamping fasteners of this kind.

According to FIG. 4, front and side longitudinal clamping fasteners 13 and 14, respectively, are provided, which contain screws and are therefore readily removable. Corresponding front and side corner clamping fasteners 15 and 16, respectively, are provided in the inner corners of the display frame 12. If the length of the display frame 12 is considerable, it is recommended that inset supporting bars 17 also be provided, to prevent sagging.

Figure 5:
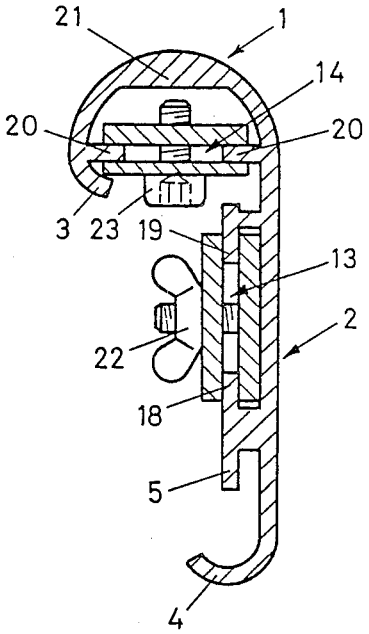
FIG. 5 is a cross section of a supporting frame element having longitudinal support fasteners.

The embodiment of the supporting frame elements for receiving the clamping fasteners 13–16 and of the supporting bars will become apparent from FIG. 5, which shows a cross section of the supporting frame element of FIGS. 1 and 2 again. For receiving the front longitudinal clamping fasteners 13 as well as the legs of the front corner clamping fasteners 15, the inside face of the wide side 2 is provided with two rail-like protrusions 18 and 19, wherein the protrusion 18 is integral with the rail-like protrusion 5 provided for suspending the tensioning springs, and the protrusion 19 is integral with the rail-like protrusion 9 that is also provided for suspending the tensioning springs. For receiving the side longitudinal clamping fasteners 14 and the legs of the side corner clamping fasteners 16, two further rail-like protrusions 20 are provided in the interior of the semicircularly curved narrow side 1. To enable placement of the supporting bars 17 against the inner walls of the semicircularly curved narrow sides, the narrow sides are provided with a thickened portion 21 as shown in FIG. 5, which is embodied as a flat bearing surface.

In the clamping fastener 13 shown in FIG. 5, a wing nut 22 is provided as an actuating device known per se. For reasons of lack of space, a socket-head screw 23 is advantageously used as the actuating device for the clamping fastener 14.

The exemplary embodiments of supporting frame elements described above have the narrow side of the supporting element curved in a semicircular arc. Naturally it is also possible for this narrow side to be embodied such that only part of it is in the form of a circular arc, namely preferably in the two edge portions of the narrow side. In that case it is still possible for the flat reproduction to be pulled from the wide sides across the narrow sides toward the back sides of the profiled frame elements and there fastened smoothly by means of the displaceable tensioning springs that can be suspended in the supporting frame elements. Because of the shorter radius of curvature at the edges, this kind of embodiment, having narrow sides that are only partly circularly curved, may be advantageous particularly whenever a plurality of supporting and suspending apparatuses, as already mentioned, are to be placed end to end to produce a large image.

The present supporting and suspending apparatus, or its supporting frame elements, can be produced relatively simply and cost-effectively from a light metal, with high rigidity. Suspending and fastening a flat reproduction on paper, plastic material or fabric is easily accomplished. The "borderless" supporting of a reproduction that the invention makes possible is of very great interest both practically and esthetically.

What is claimed is:

1. A supporting and suspending apparatus for flat reproductions, in particular photographic reproductions comprising:

a supporting and suspending frame;

a plurality of frame elements from which the supporting and suspending frame is assembled, said frame elements comprising:

inner support members for the displaceable suspension of tensioning springs adapted to be fastened to edges of the reproduction, and inner support means for attaching clamping fasteners so as to enable detachably assembling said supporting and suspending frame from a plurality of frame elements, each frame element having a generally strip-shaped cross-section with one end at least partly curved such that each frame element has a narrow side at least partly circularly curved and a contiguous flat wide side at right angles thereto; and at least one support member of said inner support members provided on an inside face of the wide side of each frame element extending in the longitudinal direction of the wide side and being open in the transverse direction of the wide side, in order to suspend tensioning springs directly therein and displace them along the at least one support member.

2. The supporting and suspending as defined by claim 1, wherein the inside face of the wide side, in an end portion remote from the narrow side, is provided with the at least one support member such that the flat reproduction can be placed across the flat wide side and the at least partly circularly curved narrow side when it is being suspended, and each tensioning spring fastened to an associated edge of the reproduction is adapted to be suspended in the at least one support member of the wide side and displaced along the at least one support member.

3. The supporting and suspending apparatus as defined by claim 1, wherein the inside face of the wide side is provided, at an end portion adjoining the narrow side, with an inner support member such that the flat reproduction can be placed behind the wide side, and each tensioning spring fastened to an associated edge of the reproduction can be suspended in said inner support member of the wide side and displaced along said inner support member.

4. The supporting and suspending apparatus as defined by claim 1, wherein the end portion of the wide side remote from the narrow side of the frame element is embodied at least approximately in circularly curved fashion, the radius of the circular arc of this end portion being smaller than that the of the narrow side.

5. The supporting and suspending apparatus as defined in claim 1, wherein the inside of the circularly curved narrow side of the frame element is provided with a flat bearing surface for a frame supporting bar.

6. The supporting and suspending apparatus as defined by claim 1, wherein the inside faces of the narrow side and wide side of the frame element are provided with rails for receiving the clamping fasteners.

7. A flat reproduction having a plurality of corner portions for use in the supporting and suspending apparatus as defined by claim 1, each said corner portion having an inwardly extending cut such that edges of the two edge portions of the reproduction, when wrapped about the narrow side of the supporting members of the apparatus which are perpendicular to one another, come to abut one another directly.

8. A frame element for a supporting and suspending apparatus comprising:

a narrow side at least partly circularly curved;

a contiguous flat wide side extending in a longitudinal direction at right angles with respect to the narrow side; and at least one supporting member provided on an inside face of the wide side extending in the longitudinal direction of the wide side in order to suspend tensioning springs directly therein, said at least one supporting member having a generally strip-shaped cross-section with an end at least partly curved

* * * * *